US007605760B2

(12) United States Patent
Kim et al.

(10) Patent No.: US 7,605,760 B2
(45) Date of Patent: Oct. 20, 2009

(54) CONCURRENT MODE ANTENNA SYSTEM

(75) Inventors: Young-eil Kim, Suwon-si (KR); Chang-won Jung, Hwaseong-si (KR); Seunghwan Yoon, Oakland, CA (US); Franco De Flaviis, Oakland, CA (US); Hyoung-woon Park, Seongnam-si (KR)

(73) Assignees: Samsung Electronics Co., Ltd., Suwon-si (KR); Regents of The University of California, Oakland, CA (US)

( * ) Notice: Subject to any disclaimer, the term of this patent is extended or adjusted under 35 U.S.C. 154(b) by 110 days.

(21) Appl. No.: 11/785,789

(22) Filed: Apr. 20, 2007

(65) Prior Publication Data

US 2008/0258977 A1 Oct. 23, 2008

(51) Int. Cl.
*H01Q 1/38* (2006.01)
*H01Q 1/00* (2006.01)

(52) U.S. Cl. ..... 343/700 MS; 343/722; 343/850

(58) Field of Classification Search ..... 343/700 MS, 343/722, 850
See application file for complete search history.

(56) References Cited

U.S. PATENT DOCUMENTS

| | | | | |
|---|---|---|---|---|
| 5,986,609 | A * | 11/1999 | Spall | 343/702 |
| 7,180,449 | B2 * | 2/2007 | Liang et al. | 343/700 MS |
| 7,196,597 | B2 * | 3/2007 | Saitou et al. | 333/204 |
| 7,250,834 | B2 * | 7/2007 | Saitou et al. | 333/204 |
| 7,365,684 | B2 * | 4/2008 | Liang et al. | 343/700 MS |
| 7,369,094 | B2 * | 5/2008 | Song et al. | 343/816 |

* cited by examiner

*Primary Examiner*—Hoang V Nguyen
(74) *Attorney, Agent, or Firm*—Sughrue Mion, PLLC

(57) ABSTRACT

A multiband antenna system is provided. The system includes a substrate; an antenna which is disposed on a first side and a second side of the substrate, and produces a resonance in a plurality of frequency bands; a plurality of feeders which are disposed on the first side of the substrate; and a filter which is disposed on the first side of the substrate, is coupled to an end of the antenna, and transfers signals of the plurality of frequency bands output from the antenna to respective feeders of the plurality of the feeders.

18 Claims, 10 Drawing Sheets

CONCURRENT MODE ANTENNA SYSTEM

BACKGROUND OF THE INVENTION

1. Field of the Invention

Systems consistent with the present invention relate to a concurrent mode antenna system, and more particularly to a concurrent mode antenna system enabling various wireless communication services by transmitting and receiving radio signals of a plurality of frequency bands on a single antenna.

2. Description of the Related Art

With advances of radio communication technology, various radio communication services available using wireless terminals such as mobile phones, personal digital assistants (PDAs), persona computers, and notebook computers are under development, for example, Global System for Mobile communication (GSM), Personal Communication Services (PCS), World Interoperability for Microwave Access (WiMAX), Wireless Local Area Network (WLAN), Wireless Broadband Internet (WiBro), Bluetooth, etc.

The GSM service uses a 890~960 MHz band, the PCS service uses a 1.8 GHz band, and the WiMAX service uses a 3.6~3.8 GHz band. The WLAN service uses a 2.4 GHz band according to the Industrial, Scientific & Medical (ISM) band in IEEE 802.11b, and a 5 GHz band according to the Unlicensed National Information Infrastructure (UNII) in IEEE 802.11a. The WiBro service uses a 2.3 GHz band and the Bluetooth service uses 2.4 GHz band.

To use radio communication services using a single wireless terminal over the various frequency bands, the related art employs a multiband antenna system as shown in FIG. 1.

The related art multiband antenna system in FIG. 1 includes a plurality of antennas 110, a plurality of band pass filters (BPFs) 120, and a plurality of radio frequency (RF) circuits 130. The antennas 110 transmit and receive signals of different frequency bands. The BPFs 120 filter the signals transmitted and received on the antennas 110 according to the intended frequency bands.

The related art antenna system of FIG. 1 is subject to a size increase because of using the antennas 110 and the BPFs 120.

To address this problem, a reconfigurable antenna system is being developed not only to receive various wireless communication services on a single antenna but also to use various services at the same time.

SUMMARY OF THE INVENTION

The present inventive concept addresses the above-mentioned and other problems and disadvantages occurring in the related art arrangement, and an aspect of the present invention is to provide an antenna system for miniaturizing an antenna structure to be embedded to a terminal by improving the antenna structure.

Another aspect of the present invention is to provide a concurrent mode antenna system for receiving various wireless communication services on a single antenna and using the services at the same time.

According to an aspect of the present invention, there is provided a multiband antenna system including a substrate; an antenna disposed on a front side and a back side of the substrate to produce a resonance in multi frequency bands; a plurality of feeders disposed on the front side of the substrate to output signals; and a filter disposed on the front side of the substrate and coupled to an end of the antenna, to transfer signals of different frequency bands output from the antenna to different feeders of the plurality of the feeders.

The antenna may include a first radiator disposed on the front side of the substrate and coupled to the filter with one end; and a second radiator disposed on the back side of the substrate and having one end of the second radiator coupled to an end of the first radiator through a via hole and another end of the second radiator being opened.

An area where the second radiator is disposed on the back side of the substrate may correspond to part of an area where the first radiator is disposed on the front side of the substrate.

The radiators each may be constructed by combining radiating elements which are folded at least one time.

The radiating elements may be in a Hilbert curve form.

A length of the radiating element may differ depending on the radiators.

When the radiators produce a resonance in two frequency bands, the first radiator may produce the resonance in a first frequency band of the two frequency bands, and the first radiator and the second radiator, in association with each other, may produce the resonance in a second frequency band of the two frequency bands.

The filter may be a diplexer which functions as a low pass filter and a high pass filter to apply a frequency resonating in the first frequency band and a frequency resonating in the second frequency band to different feeders.

The antenna may include a first radiator disposed on the front side of the substrate and coupled to the filter with one end; a second radiator disposed on the front side of the substrate and coupled to the other end of the first radiator with one end; and a third radiator disposed on the back side of the substrate and having one end connected to the other end of the second radiator through a via hole and the other end being opened.

An area where the third radiator is disposed on the back side of the substrate may correspond to part of an area where the second radiator is disposed on the front side of the substrate.

The radiators each may be constituted by combining radiating elements folded at least one time.

The radiating elements may be in the Hilbert curve form.

A length of the radiating element may differ depending on the radiators.

When the radiators produce resonance in three frequency bands, the first radiator may produce the resonance in a first frequency band of the three frequency bands, the first radiator and the second radiator, in association with each other, may produce the resonance in a second frequency band of the three frequency bands, and the first, second and third resonators, in association with one another, may produce the resonance in a third frequency band of the three frequency bands.

The filter may be a diplexer which functions as a low pass filter and a high pass filter, and the filter applies a frequency resonating in the first frequency band and a frequency resonating in the third frequency band to different feeders and applies a frequency resonating in the second frequency band to the feeder to which the frequency resonating in the first frequency band is applied.

BRIEF DESCRIPTION OF THE DRAWING FIGURES

These and other aspects of the present invention will become apparent and more readily appreciated from the following description of exemplary embodiments of the present invention, taken in conjunction with the accompany drawings of which:

Figure 3A:
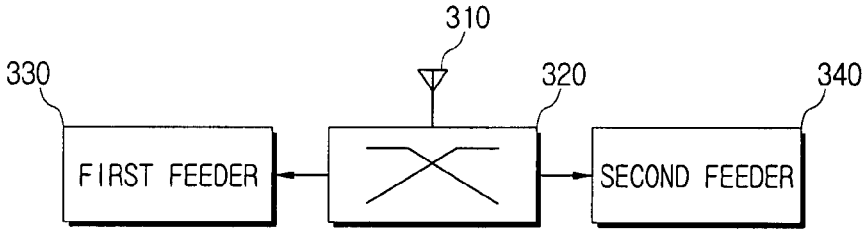
FIGS. 3A through 3D are block diagrams of a 3-band dual feed antenna system according to an exemplary embodiment of the present invention.
Figure 3B:
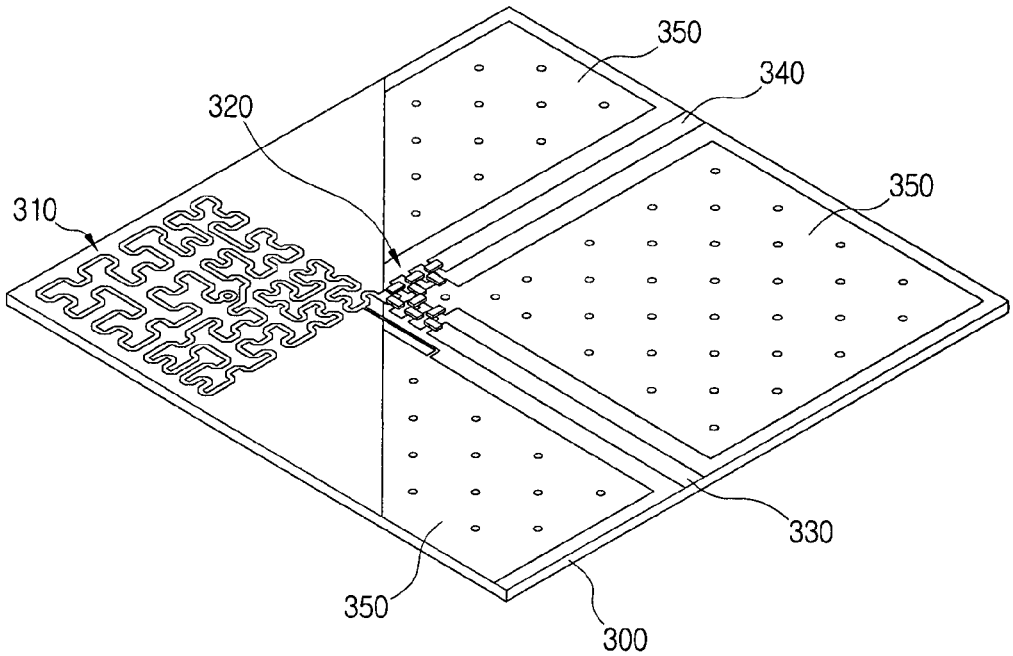
Figure 3C:
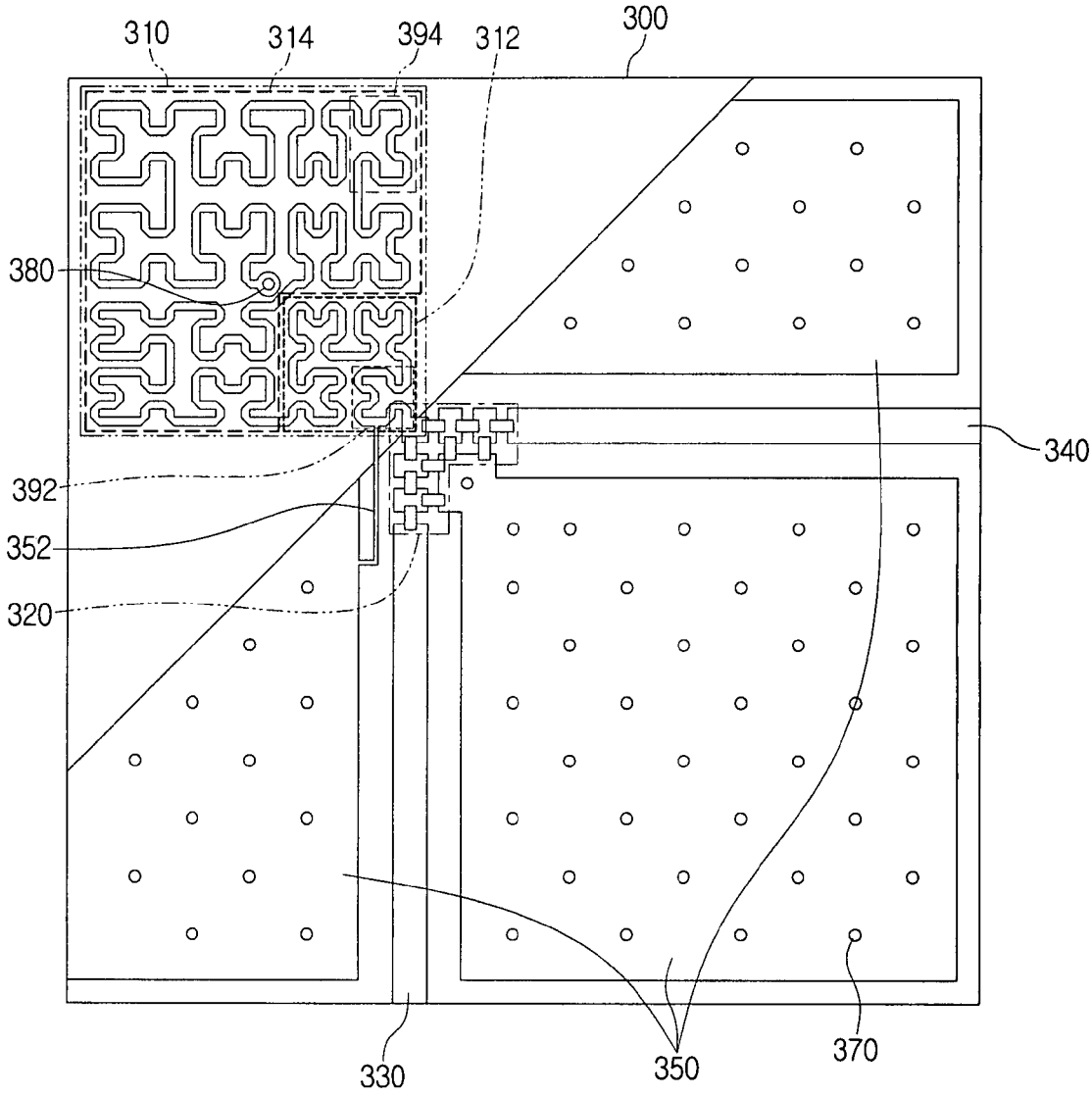
Figure 3D:
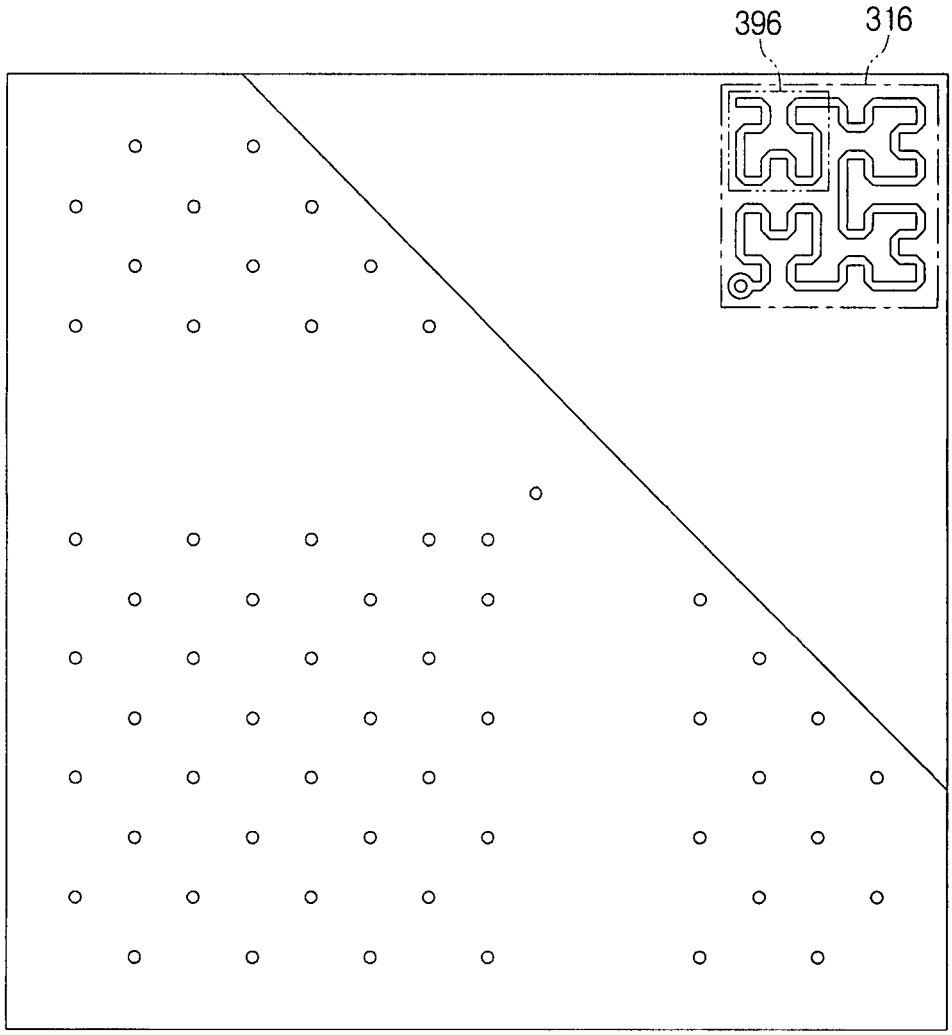
Figure 4A:
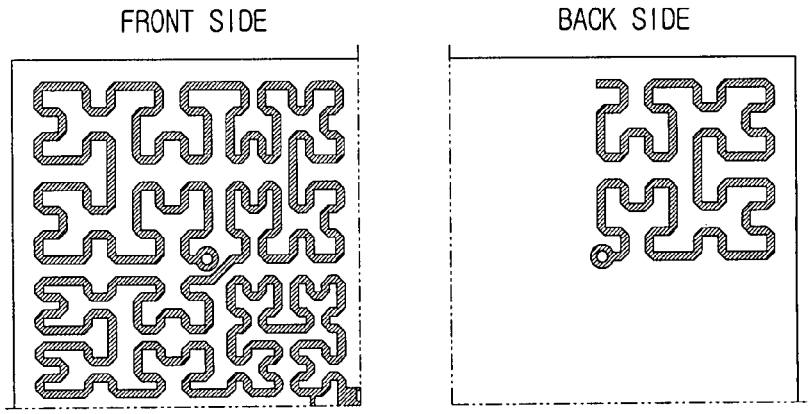
Figure 4B:
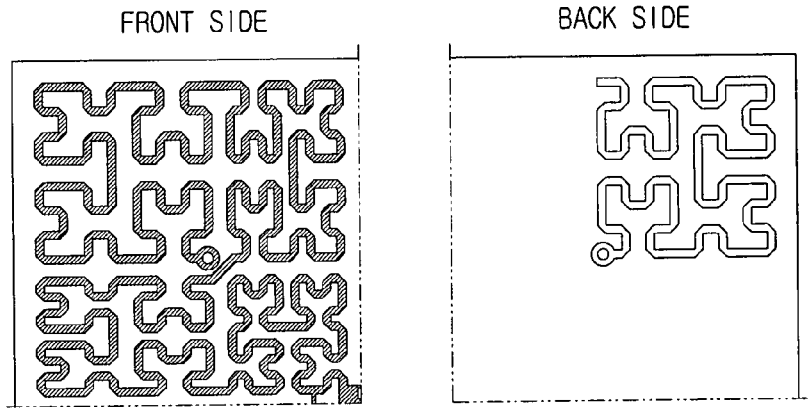
Figure 4C:
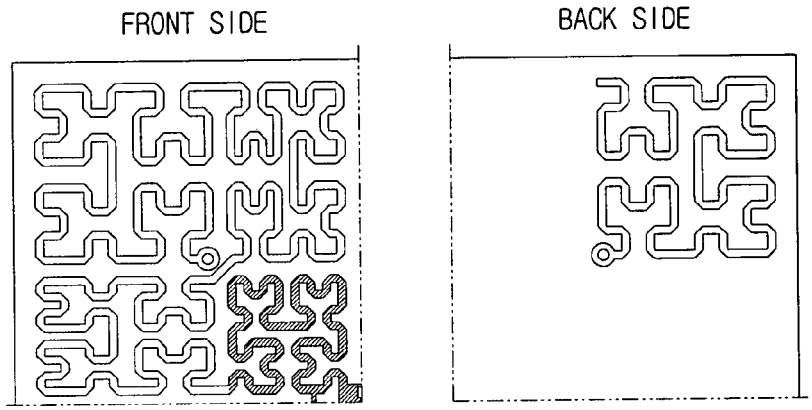
Figure 5:
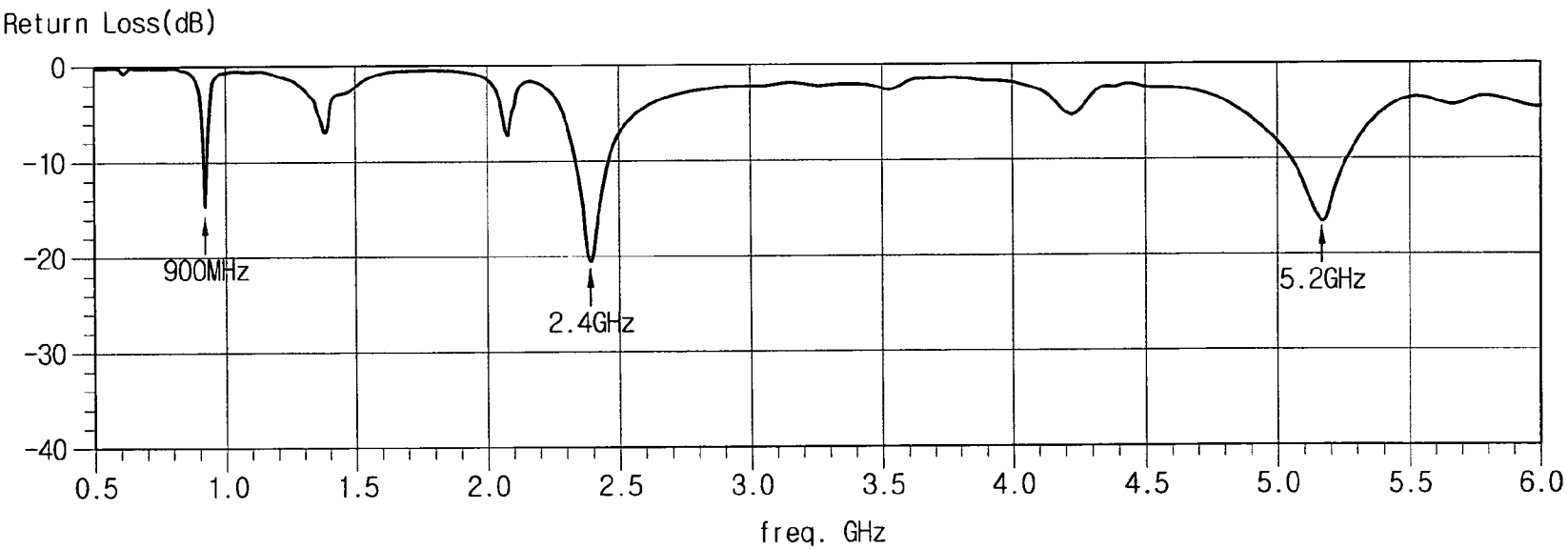
Figure 6:
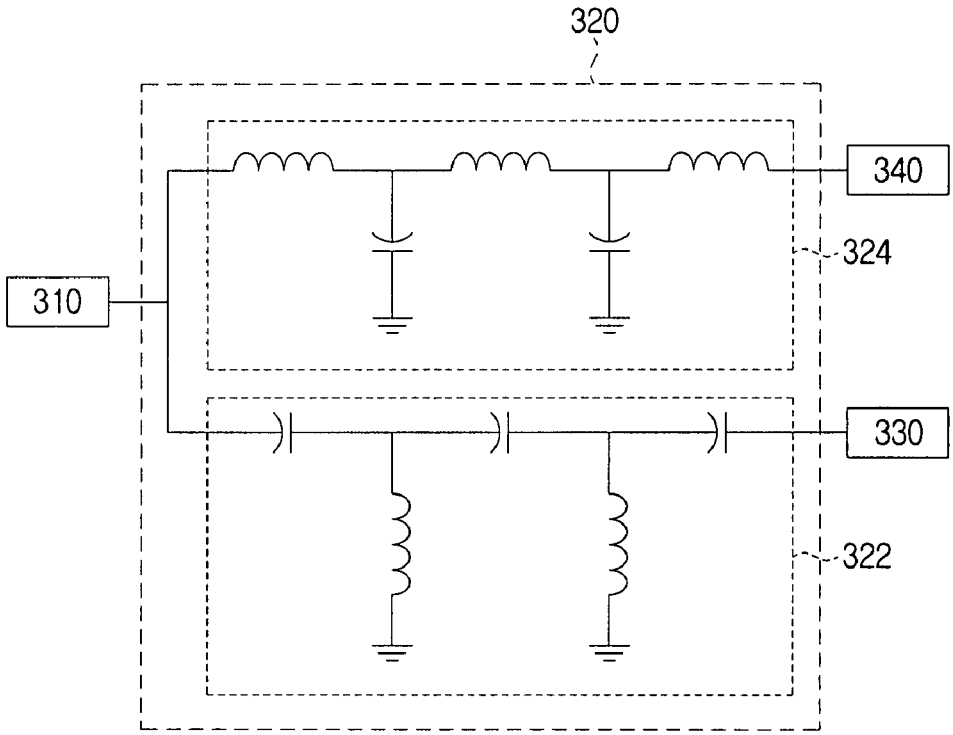
Figure 7A:
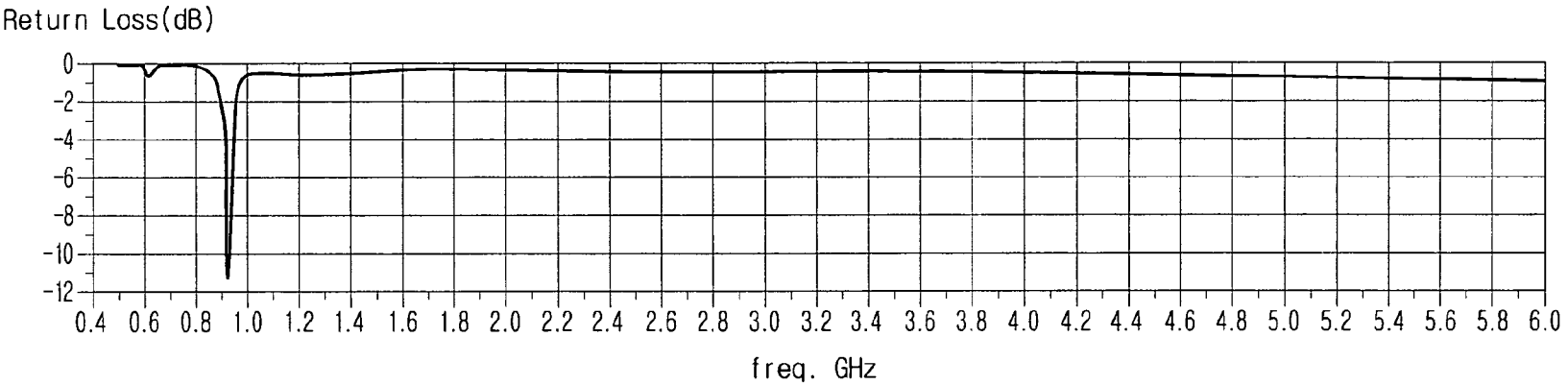
Figure 7B:
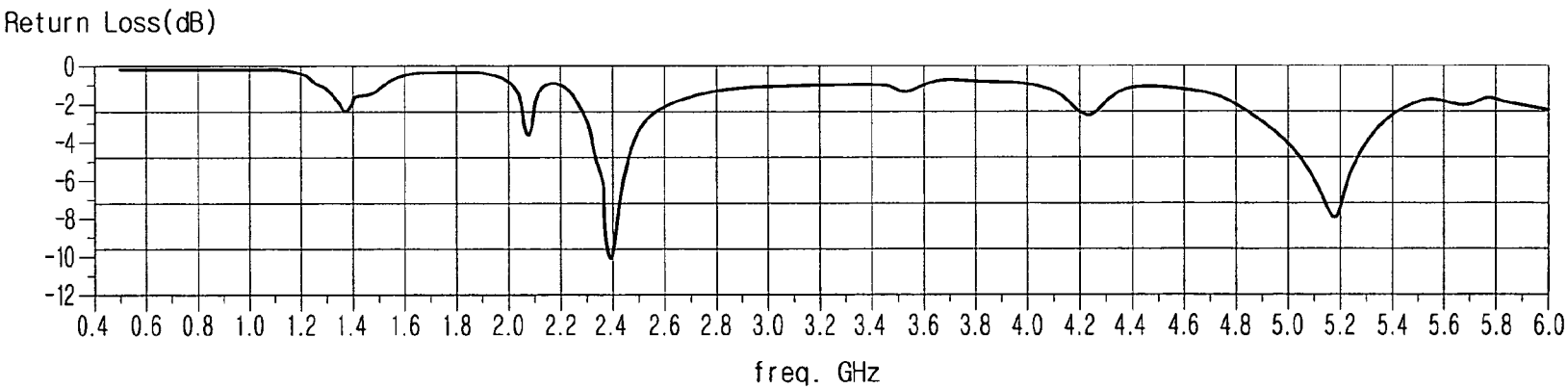

FIGS. 4A, 4B, and 4C are views illustrating a surface current distribution in a frequency resonance of the 3-band dual feed antenna system of FIGS. 3A through 3D;

FIG. 5 depicts a return loss measured for operating frequencies of the first radiator according to an exemplary embodiment of the present invention;

FIG. 6 is an equivalent circuit diagram of a diplexer according to an exemplary embodiment of the present invention;

FIG. 7A is a view illustrating a return loss measured for the operating frequencies at the first feeder according to an exemplary embodiment of the present invention;

FIG. 7B is a view illustrating a return loss measured for the operating frequencies at the second feeder according to an exemplary embodiment of the present invention.

Figure 8A:
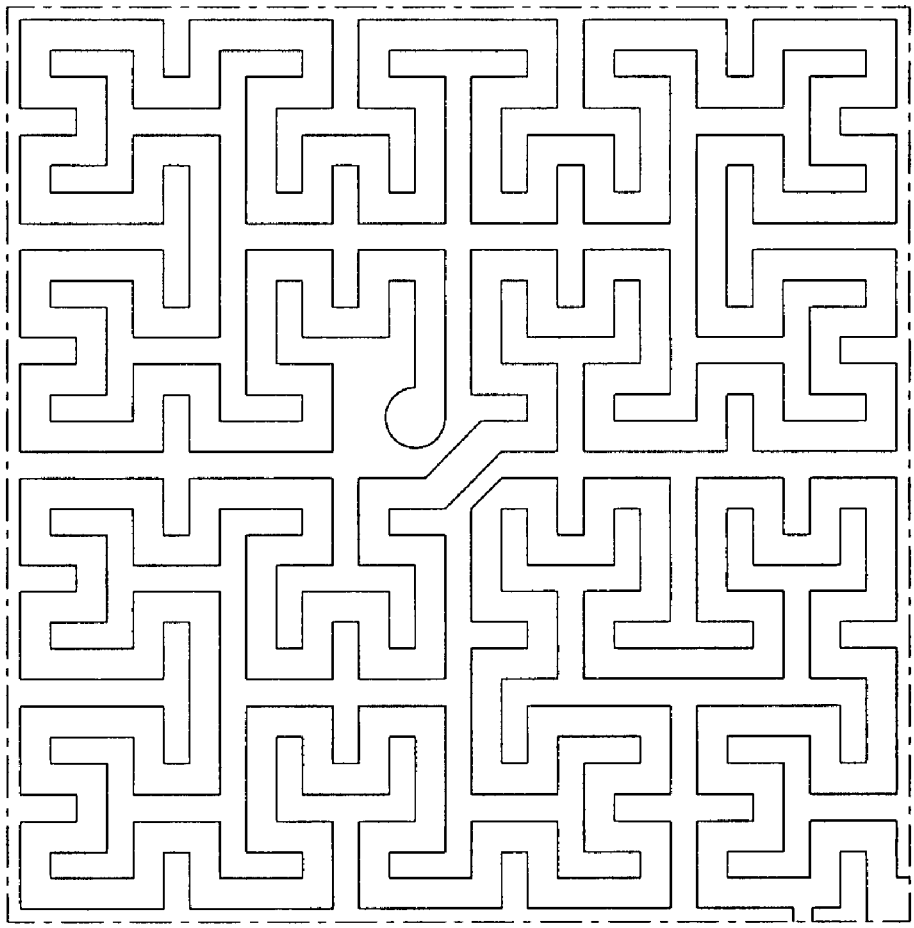
Figure 8B:
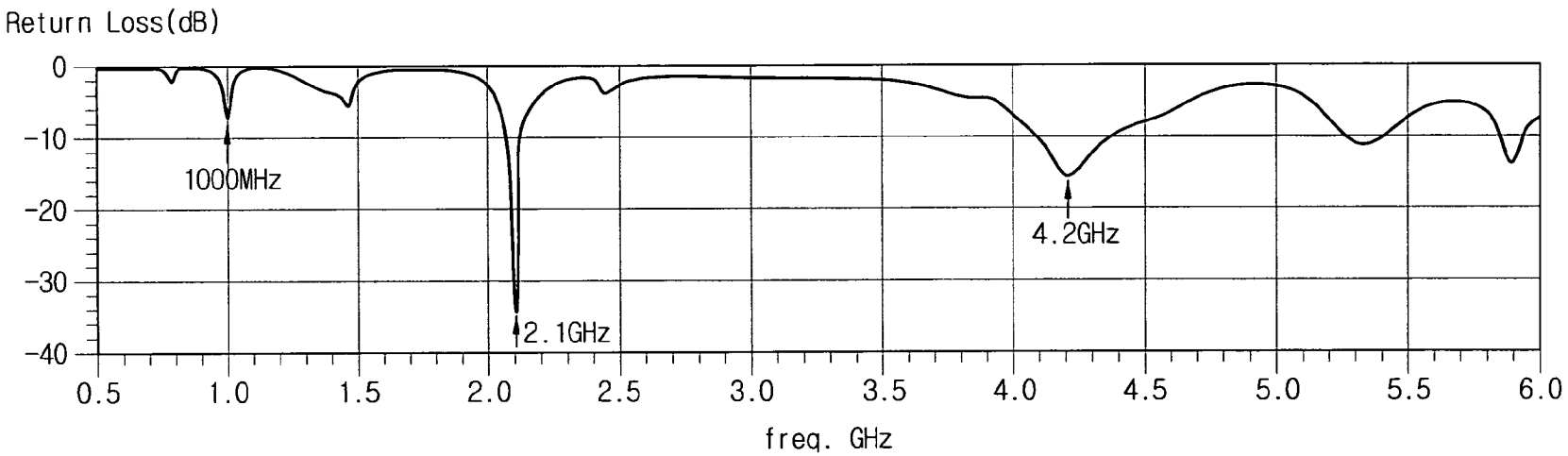

FIG. 8A is a view illustrating an antenna designed with radiating elements of a constant size according to the related art; and FIG. 8B is a view illustrating a return loss of operating frequencies in a symmetrical antenna structure according to the related art.

DETAILED DESCRIPTION OF EXEMPLARY EMBODIMENTS OF THE PRESENT INVENTION

Certain exemplary embodiments of the present invention will now be described in greater detail with reference to the accompanying drawings.

In the following description, the same drawing reference numerals are used to refer to the same elements, even in different drawings. The matters defined in the following description, such as detailed construction and element descriptions, are provided as examples to assist in a comprehensive understanding of the invention. Also, well-known functions or constructions are not described in detail, since they would obscure the invention in unnecessary detail.

Figure 1:
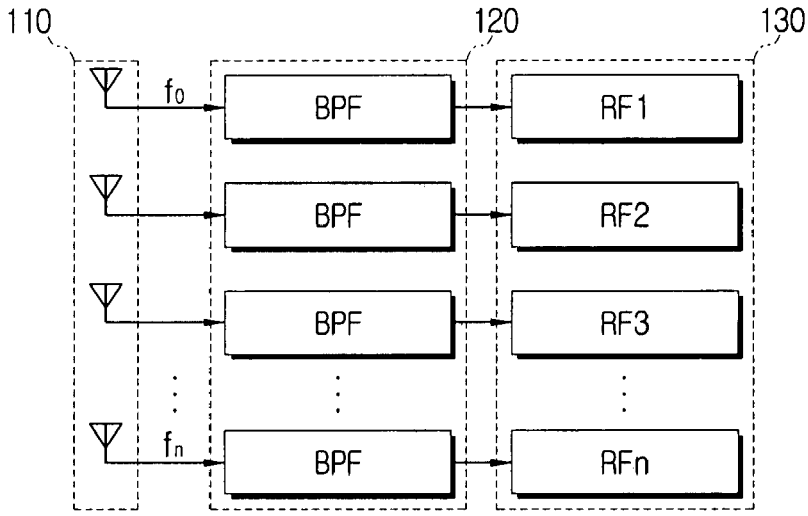
FIG. 1 (RELATED ART)
FIG. 1 is a block diagram of a related art multiband antenna system.
Figure 2:
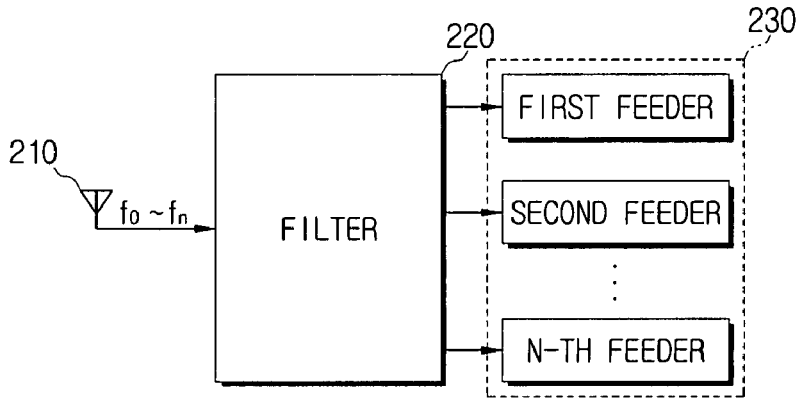
FIG. 2 is a simplified diagram of a concurrent mode antenna system according to an exemplary embodiment of the present invention.

FIG. 2 is a simplified diagram of a concurrent mode antenna system according to an exemplary embodiment of the present invention. The antenna system includes a single antenna 210 for transmitting and receiving signals of a plurality of frequency bands (e.g., $f_0$ to $f_n$), a filter 220 for separating the signals fed from the antenna 210 according to the frequency bands, and a feeder 230 for transferring the frequency signals separated at the filter 220 to a signal processing circuit (not shown).

The antenna 210 receives signals of the plurality of frequency bands and applies the received signals to the filter 220, or transmits a signal of a specific frequency band fed from the filter 220.

The filter 220 separates the signals fed from the antenna 210 according to the frequency bands, and provides the separated signals to the signal processing circuit via the feeder 230, or provides a signal of a frequency band from the signal processing circuit to the antenna. Note that a signal corresponding to a frequency band or signals corresponding to the plurality of the frequency bands may be fed from the feeder 230. In doing so, the antenna 210 can operate in a concurrent mode to transfer the plurality of signals through the feeder 230 at the same time.

The signal processing circuit is coupled to the feeder 230. The signal processing circuit can be configured as a single RF circuit or a plurality of RF circuits.

Referring to FIGS. 3A through 3D, a 3-band dual feed antenna system using a single antenna according to an exemplary embodiment of the present invention will now be described in detail.

FIG. 3A is a block diagram of the 3-band dual feed antenna system according to an exemplary embodiment of the present invention. The 3-band dual feed antenna system includes a single antenna 310, a diplexer 320, and a first feeder 330 and a second feeder 340. The antenna 310 transmits and receives signals at three frequencies. The diplexer 320 separates the signals fed from the antenna 310 based on the frequency bands, provides a signal of low-frequency band to the first feeder 330, and provides a signal of high-frequency band to the second feeder 340. The first feeder 330 and the second feeder 340 forward the signals to a signal processing circuit (not shown) to process the signals fed from the diplexer 320.

For purposes of example only, the following description explains an exemplary case where the single antenna 310 receives signals of 900 MHz, 2.4 GHz, and 5.2 GHz bands, and the diplexer 320 applies signals below a 1 GHz band to the first feeder 330 and signals over the 1 GHz band to the second feeder 320 among the signals fed from the antenna 310 based on 1 GHz. However, one skilled in the art will appreciate that other frequency bands may be used.

FIG. 3B is a perspective view of the 3-band dual feed antenna system printed on a dielectric substrate 300 according to an exemplary embodiment of the present invention, FIG. 3C is a front view of the antenna system of FIG. 3B, and FIG. 3D is a rear view of the antenna system of FIG. 3B.

Referring to FIGS. 3B and 3C, the antenna system includes a monopole antenna 310 disposed in areas of a front side and a back side of the dielectric substrate 300, a diplexer 320 disposed on the front side of the dielectric substrate 300 and coupled to one end of the antenna 310, two feeders 330 and 340 coupled to the diplexer 320, and a ground plane 350 disposed on areas of the front side and the back side of the dielectric substrate 300. It is advantageous that the thickness of the dielectric substrate 300 is about 0.8 mm and the antenna 310 printed on the front side of the dielectric substrate 300 is accommodated within a area of about 14 mm×about 14 mm on the dielectric substrate 300. However, other thicknesses and sizes are contemplated.

As best shown in FIG. 3C, the antenna 310 can be divided to a first radiator 312 and a second radiator 314 disposed on the front side of the dielectric substrate 300, and a third radiator 316 (see FIG. 3D) disposed on the back side of the dielectric substrate 300. The 3-band antenna system uses the first radiator 312 to resonate at a first frequency, uses the second radiator 314 in association with the first radiator 312 to resonate at a second frequency, and uses the third radiator 316 in association with the first radiator 312 and the second radiator 314 to resonate third frequency. Advantageously, each of the first, second, and third radiators 312, 314, and 316 is formed by combining a plurality of radiating elements. Thus, the first radiator includes a plurality of radiating elements, an example of which is radiating element 392. Similarly, the second radiator includes a plurality of radiating elements, an example of which is radiating element 394, and the third radiator includes a plurality of radiating elements, an example of which is radiating element 396. Each of the radiating elements is folded several times, and is in a Hilbert curve form.

Referring to FIG. 3C, a first end of the first radiator 312 is coupled to the diplexer 320 and a second end of the first radiator 312 is coupled to a first end of the second radiator 314. One point of the first radiator 312 contacts with the ground plane 350 through a short pin 352. Meanwhile, the first radiator 312 operates in the first frequency band and produces a first frequency resonance. In this exemplary embodiment of the present invention, it is advantageous to implement the first radiator 312 to produce the first frequency resonance of about 5.2 GHz. For doing so, the total length of the first radiator 312 corresponds to ¼ wavelength of the operating frequency in the first frequency band for the resonance at the first radiator 312.

Also, it is advantageous to implement the first radiator 312 in a Hilbert curve folded at least one time. Accordingly, it is possible to reduce the area occupied by the first radiator 312 on the dielectric substrate 300.

The first end of the second radiator 314 is coupled to the second end of the first radiator 312, and the second end of the second radiator is coupled to a first end of the third radiator 316 through a via hole 380. The second radiator 314 generates a second frequency resonance by operating in a second frequency band in the electromagnetic association with the first radiator 312. In the 3-band antenna system, the second frequency resonance results from an effect of a length expansion of the antenna portion by associating the second radiator 314 and the first radiator 312, and the length of the second radiator 314 determines the resonance frequency. In this exemplary embodiment, the second radiator 314 can be implemented to generate the second frequency resonance of about 2.4 GHz.

It is advantageous that the second radiator 314 is implemented by combining radiating elements 394 in the Hilbert curve form folded at least one time, like the first radiator 312, and that a length of the radiating element of the second radiator 314 is different from the length of the radiating element of the first radiator 312. More advantageously, the length of the radiating element 394 of the second radiator 314 is greater than the length of the radiating element 392 of the first radiator 312.

A first end of the third radiator 316 is coupled to the second end of the second radiator 314 through the via hole 380, and the second end of the third radiator is opened and printed on the back side of the dielectric substrate 300. Advantageously, the portion occupied by the third radiator 316 on the back side of the dielectric substrate 300 corresponds to an area where the second radiator 314 is disposed on the front side of the dielectric substrate 300. The third radiator 316 operates in the third frequency band and produces the third frequency resonance by electromagnetically associating with the second radiator 314 and the first radiator 312. In the 3-band antenna system, the third frequency resonance results from a length expansion effect of the antenna portion by coupling the third radiator 316 with the first radiator 312 and the second radiator 314, and the length of the third radiator 316 determines the resonance frequency. In this exemplary embodiment, the third radiator 316 can be implemented to generate the third frequency resonance around 900 MHz.

It is advantageous that the third radiator 316 is implemented by combining radiating elements 396 in the Hilbert curve form folded at least one time like the first radiator 312 and the second radiator 314, and that the length of the radiating element 396 of the third radiator 316 is different from the length of the radiating elements 392 and 394 of the first radiator 312 and the second radiator 314. More advantageously, the length of the radiating element 396 of the third radiator 316 is greater than the length of the radiating elements 392 and 394 of the first radiator 312 and the second radiator 314.

The diplexer 320 is coupled to the feeder of the antenna in series and is responsible for filtering signals. The diplexer 320, which functions as both a low pass filter and a high pass filter, separates the multiband signals fed from the single antenna and transmits the separated signals to the different feeders of the plurality of feeders. In this exemplary embodiment, a first area 322 of the diplexer 320 functions as the low pass filter to provide the third frequency signal to the first feeder 330, and a second area 324 of the diplexer 320 functions as the high pass filter to provide the second frequency signal and the first frequency signal to the second feeder 340. Advantageously, the diplexer 320 is formed by combining inductors and capacitors.

It is advantageous to implement the first feeder 330 and the second feeder 340 each to feed signals from the signal processor (not shown) on the dielectric substrate 300 to the antenna through the diplexer 320.

By printing the ground plane 350 on both the front side and the back side of the dielectric substrate 300 and coupling various sections of the ground plane 350 together through via holes 370, the antenna performance can be enhanced. It is advantageous that an interval between the via holes 370 on the ground plane 350 is less than ¼ wavelength of the operating frequency, and as an example, that the interval between the via holes 370 is less than ¼ wavelength of 5.2 GHz.

With the antenna system structured in the planar form as described above, the antenna system can function as an antenna embeddable into mobile terminals.

FIGS. 4A, 4B, and 4C are views illustrating the surface current distribution in the frequency resonance of the 3-band dual feed antenna system. FIG. 4A depicts the surface current distribution in the third frequency resonance of the antenna system, FIG. 4B depicts the surface current distribution in the second frequency resonance of the antenna system, and FIG. 4C depicts the surface current distribution in the first frequency resonance of the antenna system.

Referring to FIG. 4A, the third frequency resonance (about 900 MHz) is produced by combining the first radiator 312, the second radiator 314, and the third radiator 316. The second radiator 314 in FIG. 4B generates the second frequency (about 2.4 GHz) in association with the first radiator 312, and the first radiator 312 in FIG. 4C solely generates the first frequency resonance (about 5.2 GHz). As a result, the single antenna serves as a multiband antenna. The first radiator 312 and the second radiator 314, which are parts of the antenna, are disposed on the front side of the substrate 300 and the third radiator 316 is disposed on the back side of the substrate 300, to thus minimize the area occupied by the antenna on the substrate 300.

Although not shown in the drawings, when the first radiator solely produces the first frequency resonance, slight current flows through the second radiator and the third radiator as well. Yet, the weak current does not contribute to the frequency resonance.

FIG. 5 is a view illustrating a return loss measured for the operating frequencies of the first radiator 312 according to an exemplary embodiment of the present invention. In the frequencies of about 900 MHz, about 2.4 GHz, and about 5.2 GHz, the first radiator 312 shows sharp declines of the return loss down to approximately −10 dB. Accordingly, the 3-band antenna is available in all of the frequencies of about 900 MHz, about 2.4 GHz, and about 5.2 GHz.

FIG. 6 is an equivalent circuit diagram of the diplexer 320 according to an exemplary embodiment of the present invention. In the diplexer 320 of FIG. 6, the first area 322 and the second area 324 are coupled in parallel. The first area 322 is coupled to the one end of the first radiator 312 and the first feeder 330 in series. The first area 322 transfers the third frequency signal among the signals output from the antenna, to the first feeder 330. Specifically, the first area 322 of the diplexer 320 is configured by combining the inductance and the capacitance. By arranging the inductance in series and the capacitance in parallel, the first area 322 is implemented to provide only the third frequency signal to the first feeder 330.

The second area 324 of the diplexer 320 is coupled to the one end of the first radiator 312 and the second feeder 340 in series, to thus transfer the second frequency signal and the first frequency signal to the second feeder 340. The second area 324 of the diplexer 320 is also configured by combining the inductance and the capacitance. Unlike the first area 322, the capacitance is coupled in series and the inductance is coupled in parallel so as to transfer the second frequency signal and the first frequency signal, excluding the third frequency signal, to the second feeder 340. As such, using the elements of the inductance and the capacitance, the diplexer 320 is implemented as the low pass filter for the feeder of the third frequency band and as the high pass filter for the feeder of the first frequency band, thus enhancing the isolation between the feeders.

FIG. 7A is a view illustrating a return loss measured for the operating frequencies at the first feeder 330 according to an exemplary embodiment of the present invention, and FIG. 7B depicts a return loss measured for the operating frequencies at the second feeder 340 according to an exemplary embodiment of the present invention.

Referring to FIGS. 7A and 7B, by virtue of the diplexer 320 of the antenna system, the first feeder 330 outputs the operating frequencies of the third frequency band and the second feeder 340 outputs the operating frequencies of the second frequency band and the first frequency band. Thus, it is possible to receive the 3-band frequency signals on the single antenna, divide the different frequencies to the different feeders, and receive and process the multiband frequencies at the same time. In addition, using the diplexer 320, the antenna system with the high isolation between the feeders can be realized.

Now, the frequency ratio and the operation in the used frequency band are described in case of the symmetric antenna structure having a constant size of the radiating elements of the antenna and the asymmetric antenna structure having the irregular sizes of the radiating elements.

FIG. 8A is a view illustrating an antenna designed with radiating elements of a constant size according to the related art. As shown in FIG. 8A, a size of the radiating elements forming the antenna is constant, unlike the radiating elements of the antenna according to an exemplary embodiment of the present invention described above. Namely, the related art antenna is designed symmetrically.

FIG. 8B is a view illustrating a return loss of the operating frequencies in the symmetrical antenna structure of FIG. 8A. Referring to FIGS. 5 and 8B, the symmetrical antenna of FIG. 8B shows a sharp decline in the frequencies of about 1000 MHz, 2.1 GHz, and 4.2 GHz. Compared to the asymmetrical antenna structure of FIG. 5, the symmetrical antenna of FIG. 8B can hardly operate in the frequency bands around 900 MHz, 2.4 GHz, and 5.2 GHz which are the used bands. Moreover, the frequency ratio in FIG. 8B is less than the frequency ratio in FIG. 5. It is noted that the asymmetrical antenna structure according to an exemplary embodiment of the present invention has a greater frequency ratio and operates in the used frequency bands, compared to the related art symmetrical antenna structure.

As described above, the signals output from the 3-band antenna are applied to two feeders, but the present inventive concept is not limited to only two feeders. It should be understood that the present inventive concept can easily be extended by one having ordinary skill in the art to an antenna that can resonate in a dual band or in more than 4-bands of operating frequencies.

As set forth above, the antenna size can be miniaturized by printing the single antenna on the front side and the back side of the dielectric substrate.

It is possible to use the plurality of wireless communication services on the single antenna at the same time.

Although a few exemplary embodiments of the present invention have been shown and described, it will be appreciated by those skilled in the art that changes may be made in these exemplary embodiments without departing from the principles and spirit of the invention, the scope of which is defined in the claims and their equivalents.

What is claimed is:

1. A multiband antenna system comprising:

a substrate;

an antenna which is disposed on a first side and a second side of the substrate, and produces a resonance in a plurality of frequency bands;

a plurality of feeders which are disposed on the first side of the substrate; and a filter which is disposed on the first side of the substrate, is coupled to an end of the antenna, and transfers signals in the plurality of frequency bands to respective feeders of the plurality of the feeders, wherein the antenna comprises:

a first radiator which is disposed on the first side of the substrate, wherein a first end of the first radiator is coupled to the filter; and a second radiator which is disposed on the second side of the substrate, wherein a first end of the second radiator is coupled to a second end of the first radiator through a via hole, and a second end of the second radiator is opened.

2. The multiband antenna system of claim 1, wherein an area where the second radiator is disposed on the second side of the substrate corresponds to part of an area where the first radiator is disposed on the first side of the substrate.

3. The multiband antenna system of claim 1, wherein the first and the second radiators each are formed by combining a plurality of radiating elements each of which are folded at least one time.

4. The multiband antenna system of claim 3, wherein the plurality of radiating elements are in a Hilbert curve form.

5. The multiband antenna system of claim 3, wherein a length of the radiating elements of the first radiator differs from a length of the radiating elements of the second radiator.

6. The multiband antenna system of claim 1, wherein, when the first and the second radiators produce a resonance in two frequency bands, the first radiator produces a resonance in a first frequency band of the two frequency bands, and the first radiator and the second radiator, in association with each other, produce a resonance in a second frequency band of the two frequency bands.

7. The multiband antenna system of claim 6, wherein the filter is a diplexer which functions as a low pass filter and a high pass filter to apply a frequency resonating in the first frequency band and a frequency resonating in the second frequency band to different respective feeders of the plurality of feeders.

8. The multiband antenna system of claim 1, wherein the antenna comprises:

a first radiator which is disposed on the first side of the substrate, wherein a first end of the first radiator is coupled to the filter;

a second radiator which is disposed on the first side of the substrate, wherein a first end of the second radiator is coupled to a second end of the first radiator; and a third radiator which is disposed on the second side of the substrate, wherein a first end of the third radiator is coupled to a second end of the second radiator through a via hole, and a second end of the third radiator is opened.

9. The multiband antenna system of claim 8, wherein an area where the third radiator is disposed on the second side of the substrate corresponds to part of an area where the second radiator is disposed on the first side of the substrate.

10. The multiband antenna system of claim 8, wherein the first, the second, and the third radiators each are formed by combining a plurality of radiating elements each of which is folded at least one time.

11. The multiband antenna system of claim 10, wherein the plurality of radiating elements are in the Hilbert curve form.

12. The multiband antenna system of claim 10, wherein a length of the radiating elements of each of the first, the second, and the third radiators differs.

13. The multiband antenna system of claim 8, wherein, when the radiators produce resonance in three frequency bands, the first radiator produces a resonance in a first frequency band of the three frequency bands, the first radiator and the second radiator, in association with each other, produce a resonance in a second frequency band of the three frequency bands, and the first, the second and the third resonators, in association with one another, produce a resonance in a third frequency band of the three frequency bands.

14. The multiband antenna system of claim 13, wherein the filter is a diplexer which functions as a low pass filter and a high pass filter, and the filter applies a frequency resonating in the first frequency band and a frequency resonating in the third frequency band to different respective feeders of the plurality of feeders, and applies a frequency resonating in the second frequency band to the feeder to which the frequency resonating in the first frequency band is applied.

15. The multiband antenna system of claim 1, wherein the antenna is of an asymmetrical structure.

16. The multiband antenna system of claim 1, wherein the antenna comprised of asymmetric radiating elements of different sizes.

17. The multiband antenna system of claim 1, wherein the antenna is a monopole antenna.

18. The multiband antenna system of claim 1, wherein the filter transfers the signals to the respective feeders based on the frequency band of each signal.

* * * * *